US006802623B1

(12) United States Patent
Hsu et al.

(10) Patent No.: US 6,802,623 B1
(45) Date of Patent: Oct. 12, 2004

(54) LIGHT SEAT FOR A PORTABLE LIGHT WITH AN ADJUSTMENT CAPABILITY FOR A LIGHT FIXTURE

(75) Inventors: Chih-Hua Hsu, Taichung (TW); Simon Wu, Taichung (TW)

(73) Assignee: Techway Industrial Co., Ltd., Taichung (TW)

( * ) Notice: Subject to any disclaimer, the term of this patent is extended or adjusted under 35 U.S.C. 154(b) by 0 days.

(21) Appl. No.: 10/441,571

(22) Filed: May 20, 2003

(51) Int. Cl.[7] ..... F21L 4/04

(52) U.S. Cl. ..... 362/199; 362/202; 362/205; 362/188

(58) Field of Search ..... 362/199, 188, 362/198, 197, 202, 205

(56) References Cited

U.S. PATENT DOCUMENTS 5,993,022 A * 11/1999 Neyer et al. ..... 362/199

* cited by examiner

*Primary Examiner*—Alan Sariaso
*Assistant Examiner*—Guiyoung Lee
(74) *Attorney, Agent, or Firm*—William E. Pelton, Esq.

(57) ABSTRACT

A light seat for a portable light has a handle, a light fixture and a universal adjustment assembly. The universal adjustment assembly pivotally connects the light fixture to the handle. The universal adjustment assembly has an adjustment sphere, two lateral adjustment devices and a longitudinal adjustment device. The adjustment sphere is pivotally mounted in the housing. The lateral adjustment devices are rotatably mounted in two non-circular recesses in the adjustment sphere and are securely connected to the light fixture. The longitudinal adjustment device is attached to the adjustment sphere and is rotatably mounted in the handle. With such a light seat, the light fixture can be adjusted relative to the handle in any direction, and the use of a portable light with the light seat is versatile.

8 Claims, 8 Drawing Sheets

LIGHT SEAT FOR A PORTABLE LIGHT WITH AN ADJUSTMENT CAPABILITY FOR A LIGHT FIXTURE

BACKGROUND OF THE INVENTION

1. Field of the Invention

The present invention relates to a light seat for a portable light with a light fixture and particularly to a light seat for a portable light with an adjustment assembly to point the light fixture in any direction.

2. Description of Related Art

With reference to FIG. 8, a conventional portable light in accordance with the prior art comprises a light seat (not numbered) and a battery housing (not shown). The light seat comprises a handle (80) and a light fixture (70). The handle (80) has a proximal end (not numbered) and a distal end (not shown). The light fixture (70) is attached to the proximal end of the handle (80) and has a housing (71) and an illuminating device (not shown). The battery housing is attached to the distal end of the handle (80) and is electrically connected to the illuminating device to provide electricity to the illuminating device. Accordingly, the portable light can provide illumination when the illuminating device is turned on. In addition, the housing (71) of the light fixture (70) is pivotally attached to the proximal end of the handle (80) to allow the light fixture (70) to be adjusted relative to the handle (80). Two wings (711) extend from the housing (71) and are pivotally attached to the proximal end of the handle (80) with a pivoting connector (not numbered). Multiple detents (72) are defined in each wing (711), and two protrusions (81) extend out from the handle (80) and 24 selectively engage one of the detents (72) respectively in each wing (711). The engagements between the protrusions (81) and the corresponding detents (72) holds the light fixture (70) at a desired angle relative to the handle (80).

However, the light fixture (70) of the conventional light seat can only be adjusted relative to the handle (80) around the pivoting connector. In addition, only a few detents (72) are defined in each wing (711). The adjustment of the light fixture (70) relative to the handle (80) is not versatile, and the use of the conventional light seat is limited.

To overcome the shortcomings, the present invention provides a light seat to mitigate or obviate the aforementioned problems.

SUMMARY OF THE INVENTION

The main objective of the invention is to provide an adjustment assembly to a light seat for a portable light with a light fixture to allow the light fixture to be pointed in any direction. The light seat has a handle, a light fixture and a universal adjustment assembly. The light fixture is pivotally connected to the handle through the universal adjustment assembly. The universal adjustment assembly has an adjustment sphere, two lateral adjustment devices and a longitudinal adjustment device. The adjustment sphere is rotatably mounted in the housing. The lateral adjustment devices are pivotally mounted respectively in two recesses in the adjustment sphere and are securely connected to the handle. The longitudinal adjustment device is attached to the adjustment sphere and is mounted in the handle. With such a light seat, the light fixture can be adjusted in any direction relative to the handle, and the use of the light seat is versatile.

Other objectives, advantages and novel features of the invention will become more apparent from the following detailed description when taken in conjunction with the accompanying drawings.

BRIEF DESCRIPTION OF THF DRAWINGS

DETAILED DESCRIPTION OF PREFERRED EMBODIMENT

Figure 1:
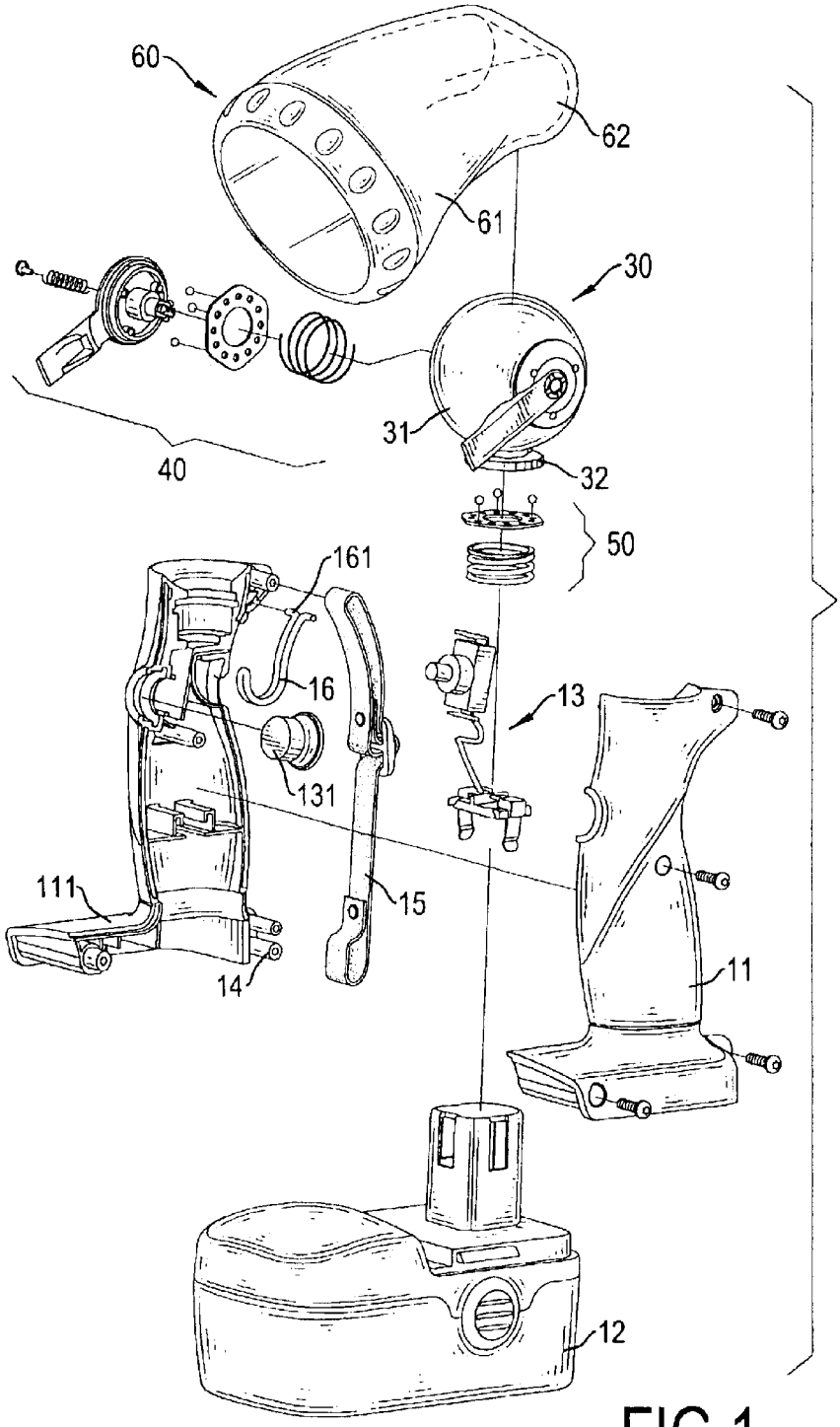
FIG. 1 is an exploded perspective view of a portable light with a light seat in accordance with the present invention.
Figure 2:
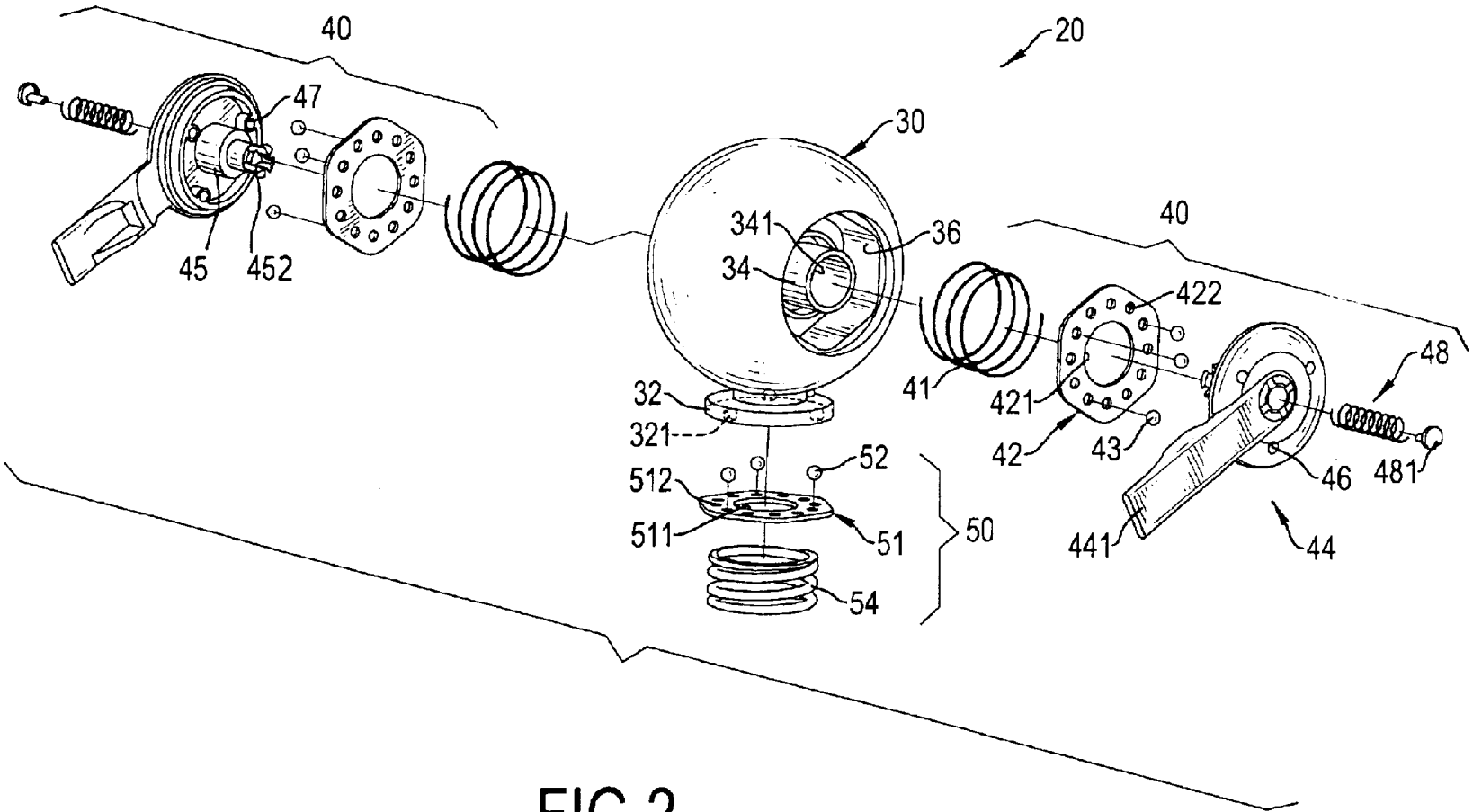
FIG. 2 is an exploded perspective view of the universal adjustment assembly in the portable light in FIG. 1.
Figure 3:
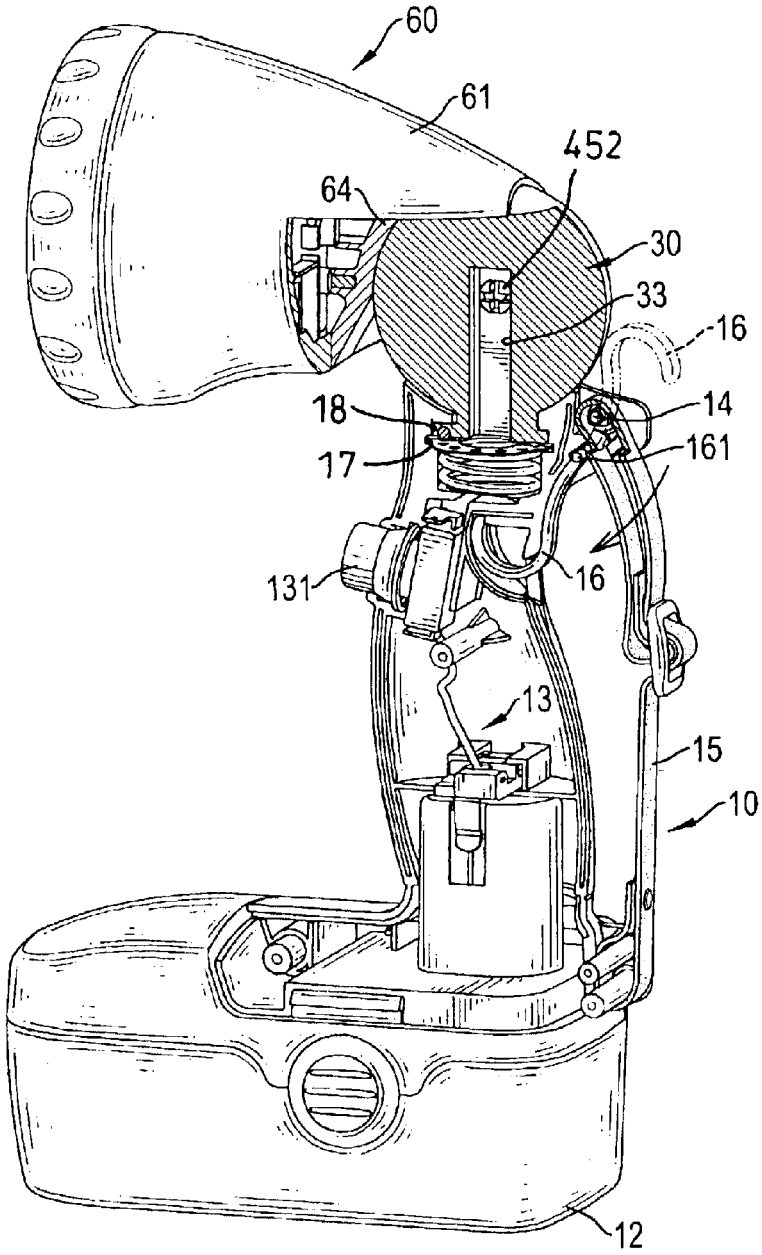
FIG. 3 is a perspective view in partial cross section of the portable light with the light seat in FIG. 1.

With reference to FIGS. 1, 2 and 3, a light seat for a portable light in accordance with the present invention comprises a handle (10), a light fixture (60) and a universal adjustment assembly (20).

The handle (10) is formed from a left shell (11), a right shell (111) and multiple screws (not numbered), has a top end (not numbered), a bottom end (not numbered), a front (not numbered), a rear (not numbered), an inner cavity (not numbered), an annular groove (18), a non-circular groove (17), an annular recess (not numbered) and a switch assembly (13) and may further include a strap (15), a hook (16) or both. The right shell (111) has multiple stubs (14) extending toward the left shell (11), and each stub (14) has a threaded axial hole (not numbered). The left shell (11) has multiple countersunk through holes (not numbered) corresponding respectively to the stubs (14) extending from the right shell (111). The screws are mounted respectively in the through holes in the left shell (11) and screw respectively into the threaded axial holes in the corresponding stubs (14) on the right shell (111), such that the left shell (11) is attached to the right shell (111) to form the handle (10). The top end of the handle (10) has a circular opening (not numbered), and the annular groove (18) is formed in the circular opening. The non-circular groove (17) is formed in the circular opening below the annular groove (18) and communicates with the annular groove (18). The annular recess is formed in the circular opening below the noncircular groove (17) and has a top end (not numbered), a bottom end (not numbered) and an internal annular lip (not numbered). The switch assembly (13) has a switch (not numbered), a clamp (not numbered), two first wires (not shown) and a pushbutton (131). The switch and the clamp are mounted in the inner cavity of the handle (10), and the pushbutton (131) extends through the front of the handle (10) and abuts the switch. The clamp electrically connects between the switch and a battery (not shown) in a battery housing (12) that is attached to the bottom end of the handle (10). The first wires are electrically connected to the switch.

When included, the strap (15) may be elastic, has two ends (not numbered), a fixed loop (not numbered) and an adjustable loop (not numbered) and is mounted on the handle (10). The fixed loop is formed at one end of the strap (15), and the adjustable loop is formed at the other end of the strap (15). The loops are mounted respectively around two of the stubs (14) to attach the strap (15) to the handle (10). The strap (15) allows a person to conveniently hold and carry the portable light.

Figure 4:
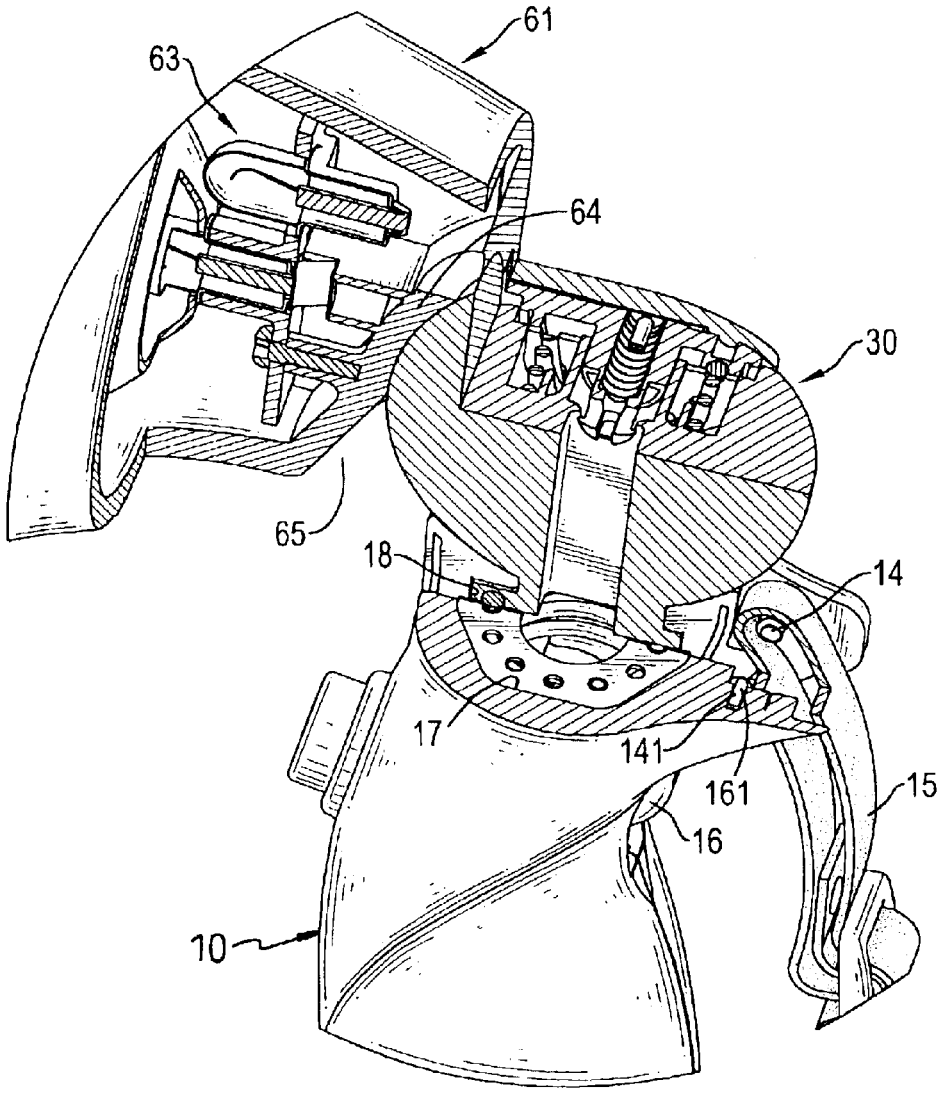
FIG. 4 is an enlarged perspective view in partial cross section of the light seat in FIG. 3.

With reference to FIGS. 1, 3 and 4, the handle (10) must also have two pivot holes (141) to mount the hook (16) on the handle (10). The pivot holes (141) are formed respectively in facing surfaces of two protrusions (not numbered) near the top rear of the right and left shells (111, 11), and a gap (not numbered) is formed between the protrusions. The hook (16) has a curved distal end (not numbered), a proximal end (not numbered) and two pivot pins (161). The pivot pins (161) are formed integrally with the hook (16), extend laterally from the proximal end of the hook (16) and are pivotally mounted respectively in the two pivot holes (141). The hook (16) allows the portable light to be hung on a projecting object (not shown) or an eye (not shown). Because the strap (15) is elastic, the strap (15) can be stretched out of the way so the hook (16) can be pivoted fully.

With reference to FIGS. 1, 3, 4 and 5, the light fixture (60) comprises a housing (61) and an illuminating device (63). The housing (61) has a bottom (not numbered), a front end (not numbered), a rear end (not numbered), a pivot chamber (62), a partition (64), two second wires (not shown), two conductive strips (641) and a bottom opening (65). The pivot chamber (62) is defined in the rear end of the housing (61) and has an inner surface (not numbered), two sides (not numbered) and two groups of keys (621). The keys (621) are formed on the inner surface and protrude into the pivot chamber (62). The partition (64) is formed in the housing (61) to separate the pivot chamber (62) from the rest of the housing and has a concave surface (not numbered) facing the pivot chamber (62). The two conductive strips (641) are mounted respectively on opposite sides of the pivot chamber (62) and extend through the partition (64). The two second wires are connected to the illuminating device (63) and respectively to the two conductive strips (641) outside the pivot chamber. The bottom opening (65) is defined in the bottom of the housing (61) and communicates with the pivot chamber (62). The illuminating device (63) is mounted in the housing (61) outside the pivot chamber (62), is electrically connected to the two second wires that connect to the switch assembly (13) in the handle (10) and faces the front end of the housing (61).

Figure 5:
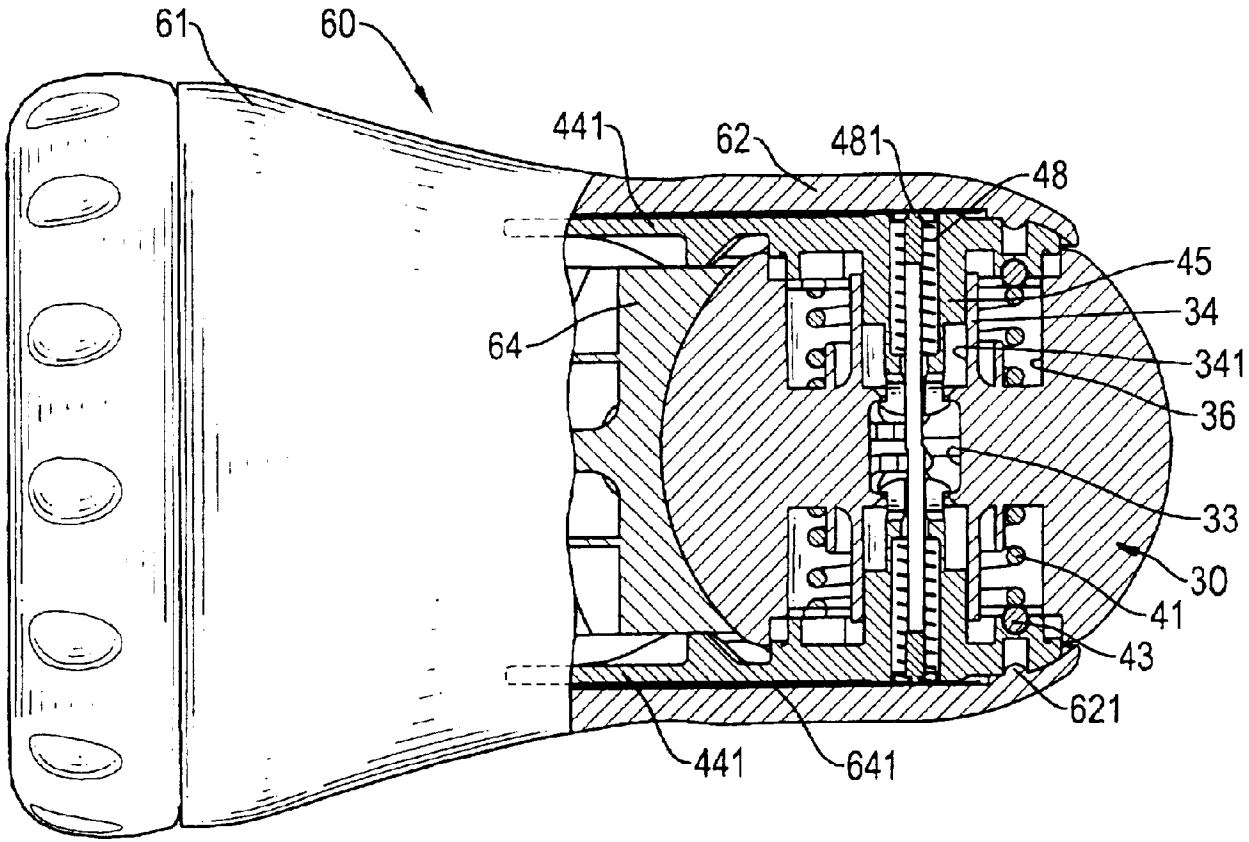
FIG. 5 is a top plan view in partial section of the light fixture with the universal adjustment device in FIG. 4.

With reference to FIGS. 1, 2 and 5, the universal adjustment assembly (20) is mounted between the handle (10) and the light fixture (60) so the light fixture (60) can be adjusted relative to the handle (10). The universal adjustment assembly (20) comprises an adjustment sphere (30), two lateral adjustment devices (40) and a longitudinal adjustment device (50). The adjustment sphere (30) has a top (not numbered), an outer periphery (not numbered), a bottom (not numbered), two sides (not numbered), a horizontal axis (not shown), a vertical axis (not shown), two recesses (36), two hollow shafts (34) and a circular base (32). The top of the adjustment sphere (30) is mounted in the pivot chamber (62) in the housing (61) through the bottom opening (65), and the outer periphery presses against the concave surface of the partition (64). Two recesses (36) are defined radially in the adjustment sphere (30) at opposite ends of the horizontal axis of the adjustment sphere (30). Each recess (36) is non-circular, for example each recess (36) may be hexagonal, and has a bottom (not shown). The hollow shafts (34) respectively have longitudinal through holes (341) and protrude respectively from the bottoms of the recesses (36) along the horizontal axis.

With further reference to FIGS. 2 to 5, the circular base (32) has a flat bottom (not numbered), a neck (not numbered), a vertical hole (33) and multiple second mounting holes (321), is formed on and protrudes from the bottom of the adjustment sphere (30) concentric with the vertical axis of the adjustment sphere (30) and is rotatably mounted in the annular groove (18) in the open top end of the handle (10). The vertical hole (33) has an inner surface (not numbered) and is defined through the base (32) and into the adjustment sphere (30) along the vertical axis of the adjustment sphere (30). The vertical hole (33) communicates with the longitudinal through holes (341) in the hollow shafts (34). The second mounting holes (321) are formed in the flat bottom around the vertical hole (33).

The lateral adjustment devices (40) are rotatably mounted respectively in the non-circular recesses (36) and are securely connected to the light fixture (60). Each lateral adjustment device (40) comprises a vertical positioning plate (42), a first biasing member (41), a cap (44), a spring (48), a conductive plug (481) and multiple balls (43). Each vertical positioning plate (42) is non-circular and has a central hole (421) and multiple first detents (422). The non-circular vertical positioning plates (42) have a shape the same as the recesses (36) in the adjustment sphere (30). Where the recesses (36) are hexagonal, the non-circular vertical positioning plates (42) are also hexagonal. The central holes (421) are defined respectively through the vertical positioning plates (42) so the vertical positioning plates (42) can be mounted respectively around the hollow shafts (34) in the recesses (36) in the adjustment sphere (30). The first detents (422) are defined through the vertical positioning plates (42) around the central holes (421).

The first biasing members (41) are mounted respectively around the hollow shafts (34) in the recesses (36) in the adjustment sphere (30) between the bottoms of the recesses (36) and the vertical positioning plates (42).

The caps (44) respectively have an inner face (not numbered), an outer face (not numbered), a post (45), a central through hole (not numbered), multiple second mounting holes (47), multiple keyholes (46) and a wing (441). Each post (45) has a proximal end (not numbered), a distal end (not numbered) and multiple hooks (452), extends from the inner face of corresponding cap (44) and is rotatably mounted in the longitudinal through hole (341) in the hollow shaft (34) in the corresponding recess (36) in the adjustment sphere (30). Multiple hooks (452) are formed on and extend out from the distal end of each post (45) and pass through the longitudinal through hole (341) and into the vertical hole (33). Each hook (452) engages the inner surface of the vertical hole (33) to rotatably attach the cap (44) to the adjustment sphere (30). The through hole (not numbered) is defined through the cap (44) and longitudinally through the post (45) and has a proximal end (not numbered), a distal end (not numbered) and an inner lip (not numbered). The inner lip is formed at the distal end that communicates with the vertical hole (33) in the adjustment sphere (30). The wing (441) is formed on and extends radially from the outer face of each cap (44), aligns with a corresponding conductive strip (641) in the housing (61) and is securely connected to the housing (61) of the light fixture (60). The balls (43) are mounted on the inner face of the cap (44) and are selectively received in the first detents (422) in the vertical positioning plate (42). Preferably, three positioning balls (43) are mounted on the inner face of the cap (44). The first mounting holes (47) are formed on the inner face of the cap (44), and the balls (43) are rotatably mounted respectively in the first mounting holes (47). The conductive plug (481) are mounted in the through hole in the cap (44), and the spring (48) is mounted between the lip at the distal end of the through hole and the conductive plug (481) at the proximal end of the through hole. The multiple keyholes (46) are defined in the outer face of the cap (44) and correspond to the keys (621) formed on the inner surface of the pivot chamber (62) in the housing (61). The keys (621) are mounted respectively in the keyholes (46) in the cap (44) to keep the cap (44) from rotating relative to the housing (10).

With reference to FIGS. 2 to 4, the longitudinal adjustment device (50) abuts and engages the base (32), is mounted in the top end of the handle (10) and comprises a horizontal positioning plate (51), a second biasing member (54) and multiple balls (52). The horizontal positioning plate (51) is mounted in the non-circular groove (17) in the top end of the handle (10) below the flat bottom of the base (32). The horizontal positioning plate (51) is the same shape as the non-circular groove (17) and may be hexagonal and has a central hole (51) and multiple second detents (512). The central hole (51) is defined through the horizontal positioning plate (51), and the second detents (512) are defined around the central hole (511). The second biasing member (54) is mounted in the annular recess in the handle (10) between the internal annular lip at the bottom end and the horizontal positioning plate (51). The balls (52) are mounted in the second mounting holes (321) in the flat bottom of the base (32) and are selectively received in the second detents (512) in the horizontal positioning plate (51).

With reference to FIGS. 1, 3, 4 and 5, the two first wires (not numbered) attached to the switch (13) extend through the second biasing member (54), the central hole (511) in the horizontal positioning plate (51), the vertical hole (33) in the adjustment sphere (30) and respectively into the through holes in the caps (44) and are attached respectively to the conductive plugs (481). The conductive plugs (481) press respectively against the conductive strips (641), such that the illuminating device (63) is electrically connected to the switch (13) through the wires, the conductive plugs (481) and the conductive strips (641).

Figure 6:
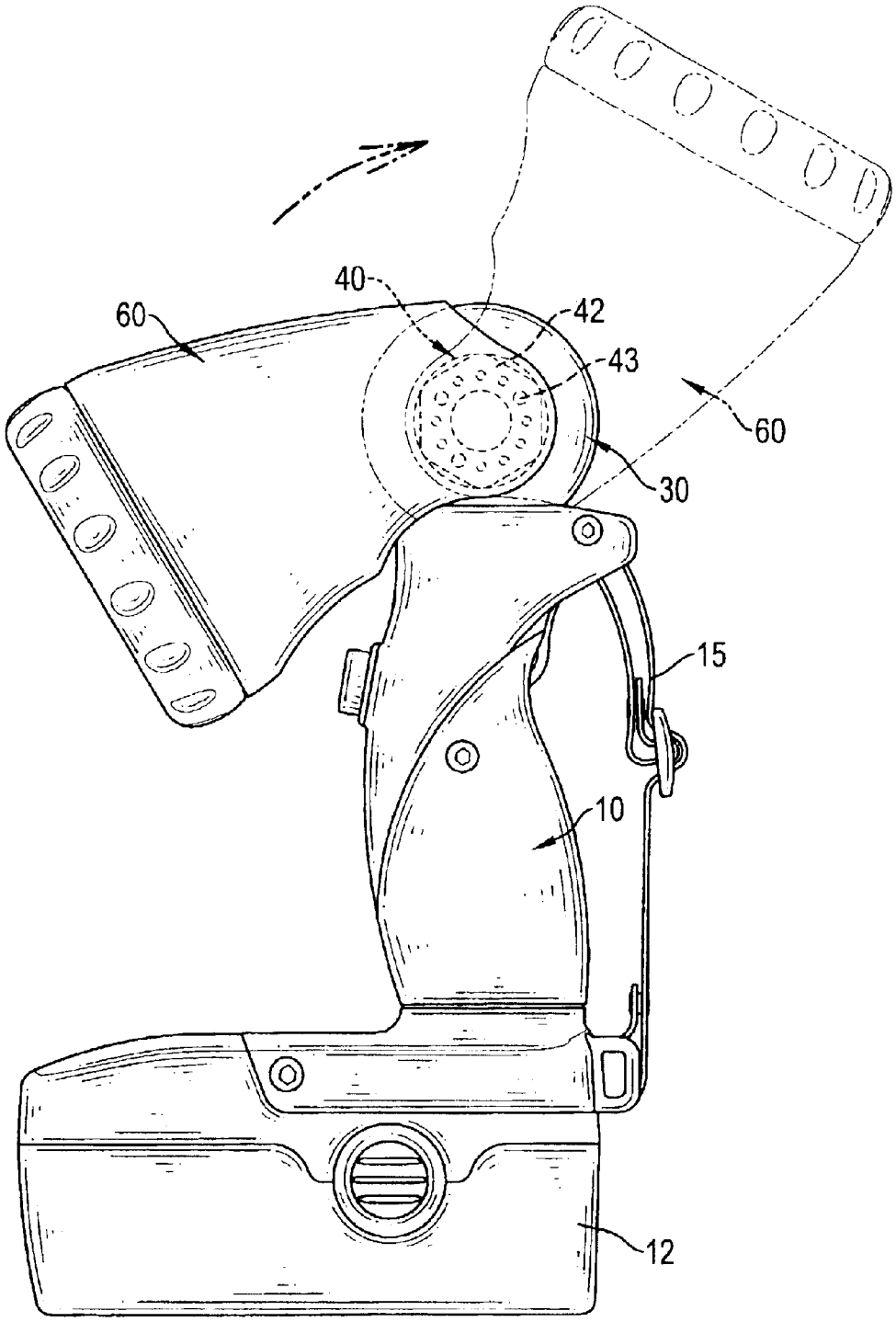
FIG. 6 is an operational side plan view of the portable light in FIG. 1.

With reference to FIGS. 3 and 6, the universal adjustment assembly (20) allows the housing (61) of the light fixture (60) to be rotated relative to the adjustment sphere (30) to adjust the angle of the light fixture (60) relative to the handle (10).

When the housing (61) of the light fixture (60) rotates relative to the adjustment sphere (30) around the horizontal axis of the sphere (30), the caps (44) of the lateral adjustment devices (40) rotate with the housing (61) relative to the adjustment sphere (30). The balls (43) in the caps (44) will rotate and push the vertical positioning plates (42) away from the corresponding caps (44) to disengage the balls (43) from the first detents (422). When the housing (61) is rotated to a desired angle, the balls (43) will engage the aligned first detents (422) in the corresponding positioning plates (42). The housing (61) will be held at the desired angle by pressing the first detents (422) in the vertical positioning plate (42) onto the balls (43). Because multiple first detents (422) are defined around each vertical positioning plate (42), the light fixture (60) can be adjusted to different elevation angles relative to the handle (10).

Figure 7:
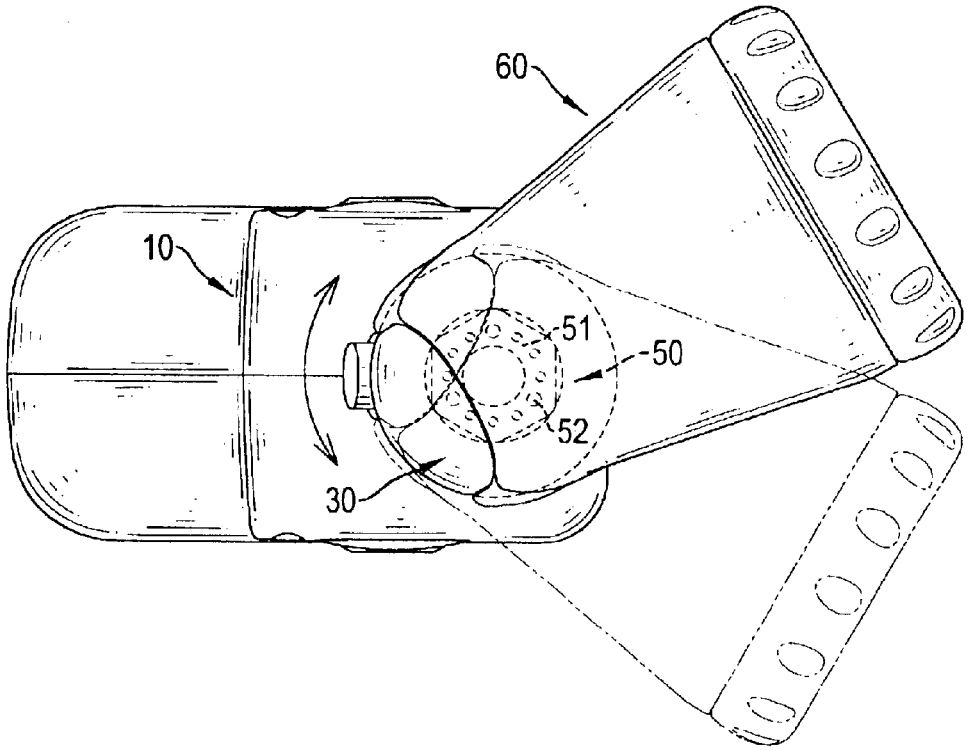
FIG. 7 is an operational top plan view of the portable light in FIG. 1.
Figure 8:
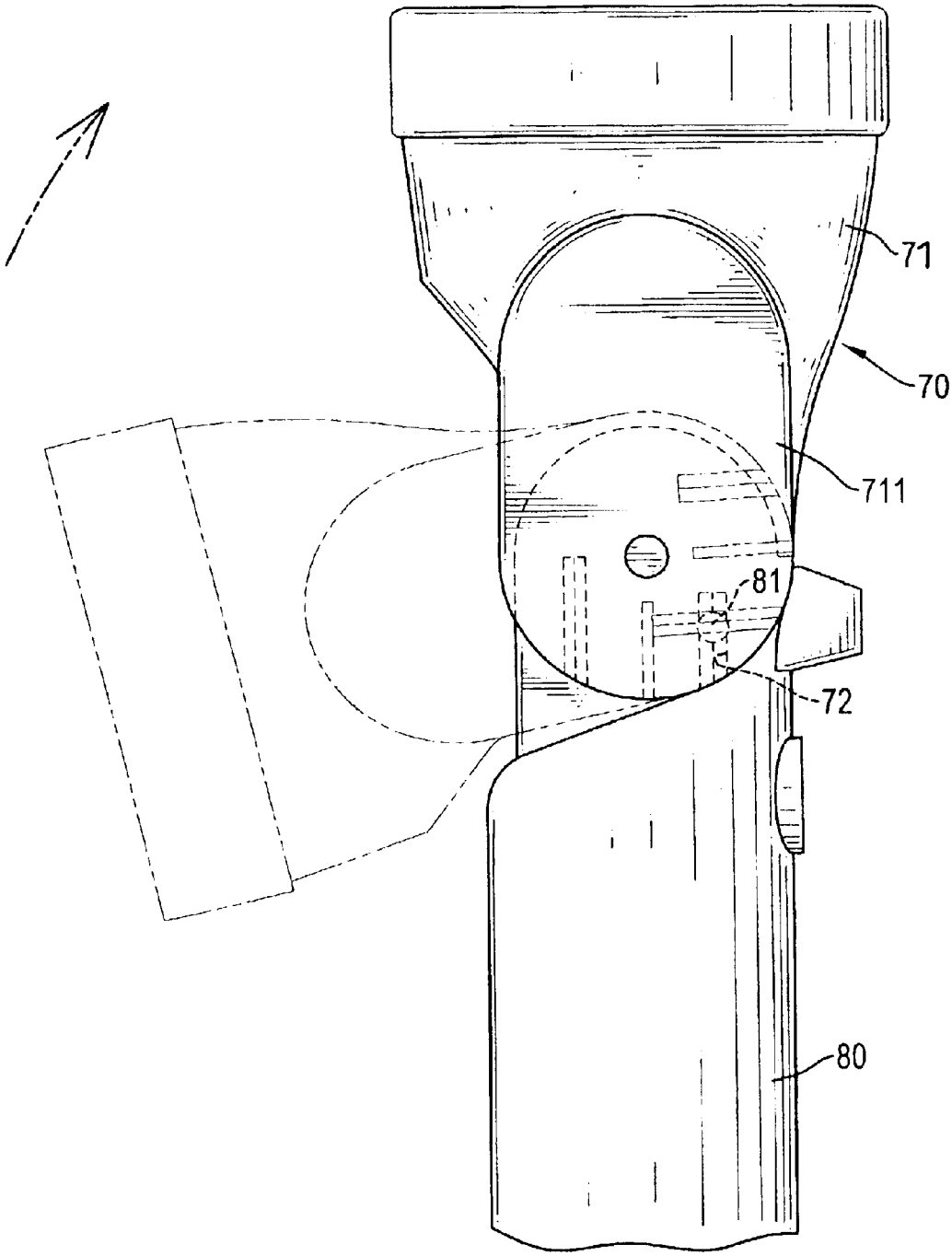
FIG.8 PRIOR ART
FIG. 8 is a side plan view of a conventional light seat and light fixture for a portable light in accordance with the prior art.

With reference to FIGS. 2, 3 and 7, when the housing (61) of the light fixture (60) is rotated around the vertical axis of the adjustment sphere (30), the adjustment sphere (30) will rotate with the housing (61) relative to the handle (10). Accordingly, the lateral angle of the light fixture (60) relative to the handle (10) will be adjusted. The balls (52) in the longitudinal adjustment device (50) will push the horizontal positioning plate (51) away from the base (32) to release the balls (52) from the second detents (512). When the light fixture (60) is rotated to a desired lateral angle, the balls (52) will engage the detents (512) in the horizontal positioning plate (51). The light fixture (60) will be held at the desired lateral angle with the engagement of the balls (52) and the second detents (512). With such a universal adjustment assembly (20), the light fixture (60) can be adjusted and held in place relative to the handle (10) in any direction, and the use of a portable light with the light seat in accordance with the present invention is versatile.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A light seat for a portable light comprising:

a handle comprising:
- a left shell with multiple countersunk through holes;
- a right shell attached to the left shell having multiple studs with threaded axial hole corresponding to the through holes; and
- multiple screws and the handle having:
- a top end with a circular opening;
- a bottom end;
- a front;
- a rear;
- an inner cavity;
- an annular groove formed in the circular opening;
- a non-circular groove formed in the circular opening below the annular groove and communicating with the annular groove;
- an annular recess formed in the circular opening below the noncircular groove and having a top end, a bottom end and an internal annular lip; and
- a switch assembly having
  - a switch mounted in the inner cavity of the handle;
  - a clamp mounted in the inner cavity of the handle and electrically connected between the switch and a battery in a battery housing attached to the bottom end of the handle;
- two first wires electrically connected to the switch; and
- a pushbutton extending through the front of the handle and abutting the switch;

a light fixture having
- a housing having
  - a bottom;
  - a front end;
  - a rear end;
  - a pivotal chamber defined in the rear end of the housing and having
    - an inner surface;
    - two sides; and
    - two groups of keys formed on the inner surface and protruding into the pivot chamber;
- a partition formed in the housing to separate the pivot chamber from the rest of the housing and having a concave surface facing the pivot chamber;

two conductive strips mounted respectively on opposite sides of the pivot chamber and extending through the partition;

two second wires connected respectively to the two conductive strips outside the pivot chamber; and a bottom opening defined in the bottom of the housing and communicating with the pivot chamber; and an illuminating device mounted in the housing outside the pivot chamber, facing the front end of the housing and electrically connected to the two second wires; and a universal adjustment assembly mounted between the handle and the light fixture and comprising an adjustment sphere mounted in the pivot chamber in the housing and having a top mounted in the pivot chamber in the housing through the bottom opening;

an outer periphery presses against the concave surface of the partition;

a bottom;

two sides;

a horizontal axis;

a vertical axis;

two non-circular recesses defined radially in the adjustment sphere at opposite ends of the horizontal axis of the adjustment sphere, and each recess having a bottom; and two hollow shafts respectively having longitudinal through holes and protruding from the bottoms of the recesses along the horizontal axis; and a circular base formed on and protruding from the bottom of the adjustment sphere concentric with the vertical axis of the adjustment sphere, rotatably mounted in the annular groove in the open top end of the handle and having a flat bottom;

a neck;

a vertical hole defined through the base and into the adjustment sphere along the vertical axis of the adjustment sphere and communicating with the longitudinal through holes in the hollow shafts in the non-circular recesses; and multiple second mounting holes formed in the flat bottom around the vertical hole;

two lateral adjustment devices rotatably mounted respectively in the non-circular recesses and securely connected to the light fixture, and each lateral adjustment device comprising a vertical positioning plate being non-circular, securely mounted in a corresponding non-circular recess in the adjustment sphere and having a central hole defined through the vertical positioning plate so the vertical positioning plate can be mounted around the hollow shaft in the corresponding recess in the adjustment sphere;

multiple first detents defined around the central hole; and a shape the same as the non-circular recesses in the adjustment sphere;

a first biasing member mounted around the hollow shaft in the corresponding recess in the adjustment sphere between the bottom of the recess and the vertical positioning plate;

a cap rotatably attached to the adjustment sphere and having an inner face;

an outer face;

a post extending from the inner face, rotatably mounted in the longitudinal through in the hollow shaft in the corresponding recess in the adjustment sphere and having a proximal end formed on the inner face, a distal end and multiple hooks formed on and extending out from the distal end, pass through the longitudinal through hole and into the vertical hole and engage the inner surface of the vertical hole;

a central through hole defined through the cap and longitudinally through the post and having a proximal end, a distal end and an inner lip formed at the distal end that communicates with the vertical hole in the adjustment sphere;

multiple second mounting holes formed on the inner face of the cap;

multiple keyholes defined in the outer face of the cap and corresponding to and holding the keys formed on the inner surface of the pivot chamber in the housing; and a wing formed on and extending radially from the cap, aligning with the conductive strip in the housing and securely connected to the housing of the light fixture;

a conductive plug is mounted in the proximal end of the central through hole in the cap, presses against the corresponding conductive strip and is attached to one of the two first wires;

a spring mounted between the lip at the distal end of the central through hole and the conductive plug multiple balls mounted respectively in the first mounting holes in the cap and selectively received in the first detents in the vertical positioning plate; and a longitudinal adjustment device engaging the circular base of the adjustment sphere and mounted in the top end of the handle, the longitudinal adjustment device comprising a horizontal positioning plate being the same shape as the non-circular groove in the top end of the handle, mounted in the non-circular groove in the top end of the handle below the flat bottom of the base, and having a central hole defined through the horizontal positioning plate and multiple second detents defined around the central hole;

a second biasing member mounted in the annular recess in the handle between the internal annular lip at the bottom end and the horizontal positioning plate;

multiple balls mounted in the second mounting holes in the flat bottom of the base and selectively received in the second detents in the horizontal positioning plate.

2. The light seat as claimed in claim 1 further comprising a strap mounted on the handle, wherein the strap has two ends, a fixed loop formed on one end and mounted around a stud on the handle and an adjustable loop formed at the other end of the strap and mounted around another stub on the handle.

3. The light seat as claimed in claim 2, wherein the strap is flexible.

4. The light seat as claimed in claim 2 further comprising a hook pivotally attached to the handle, wherein the handle further has two protrusions with facing surfaces near the top rear of the right and left shells, a gap (not numbered) between the protrusions and two pivot holes formed respectively in the facing surfaces; and the hook has a curved distal end, a proximal end and two pivot pins arms formed integrally with the hook, extending laterally from the proximal end of the hook and are pivotally mounted respectively in the two pivot holes.

5. The light seat as claimed in claim 2 further comprising a hook pivotally attached to the handle, wherein the handle further has two protrusions with facing surfaces near the top rear of the right and left shells, a gap (not numbered) between the protrusions and two pivot holes formed respectively in the facing surfaces; and the hook has a curved distal end, a proximal end and two pivot pins arms formed integrally with the hook, extending laterally from the proximal end of the hook and are pivotally mounted respectively in the two pivot holes.

6. The light seat as claimed in claim 1 further comprising a hook pivotally attached to the handle, wherein the handle further has two protrusions with facing surfaces near the top rear of the right and left shells, a gap (not numbered) between the protrusions and two pivot holes formed respectively in the facing surfaces; and the hook has a curved distal end, a proximal end and two pivot pins arms formed integrally with the hook, extending laterally from the proximal end of the hook and are pivotally mounted respectively in the two pivot holes.

7. The light seat as claimed in claim 1, wherein each recess in the adjustment sphere is hexagonal; and the vertical positioning plate of each lateral adjustment device is hexagonal and corresponds to the recess in the adjustment sphere.

8. The light seat as claimed in claim 1, wherein the non-circular groove in the open top end of the handle is hexagonal and the horizontal positioning plate of the longitudinal adjustment device is hexagonal.

* * * * *